US005080627A

United States Patent [19]

Oriya et al.

[11] Patent Number: 5,080,627

[45] Date of Patent: Jan. 14, 1992

[54] MOTORIZED TOY SYSTEM

[75] Inventors: Sousuke Oriya, Omochano; Hajime Matsumoto, Tokyo, both of Japan

[73] Assignee: Kabushiki-Kaisha Toy Box, Tokyo, Japan

[21] Appl. No.: 588,630

[22] Filed: Sep. 25, 1990

[30] Foreign Application Priority Data

Nov. 13, 1989 [JP] Japan ..... 1-1131009[U]

[51] Int. Cl.[5] ..... A63H 18/00; A63H 19/02; A63H 29/00; B60L 13/04; H02K 41/02

[52] U.S. Cl. ..... 446/444; 104/292; 310/12; 446/457; 446/467

[58] Field of Search ..... 446/444–447, 446/129, 457, 467; 310/12, 13; 104/282, 283, 281, 292, 294, 290, 291

[56] References Cited

U.S. PATENT DOCUMENTS

| | | | |
|---|---|---|---|
| 776,826 | 12/1904 | Caldwell | 104/292 X |
| 1,020,943 | 3/1912 | Bachelet | 104/134 X |
| 1,126,608 | 1/1915 | Woodruff | 310/12 |
| 2,993,299 | 7/1961 | Dingee et al. | 446/444 |
| 3,470,828 | 10/1969 | Powell et al. | 310/13 X |
| 3,618,529 | 11/1971 | Bertin | 104/290 X |
| 3,631,809 | 1/1972 | Reece et al. | 104/294 |
| 3,701,321 | 10/1972 | Lee | 310/13 X |
| 3,712,240 | 1/1973 | Donlon et al. | 310/13 X |
| 3,804,996 | 4/1974 | Monteith . | |
| 3,804,997 | 4/1974 | Schwarzler | 104/23.2 X |
| 3,829,746 | 8/1974 | Van et al. | 310/12 X |
| 3,937,149 | 2/1976 | Winkle et al. | 104/290 X |
| 4,570,092 | 2/1986 | Ishimoto | 310/12 |
| 4,623,807 | 11/1986 | Nakamura | 310/12 |
| 4,658,928 | 4/1987 | Seo | 446/444 X |

FOREIGN PATENT DOCUMENTS

| | | |
|---|---|---|
| 2038745A | 7/1980 | United Kingdom . |
| 2125748A | 3/1984 | United Kingdom . |

*Primary Examiner*—Danton D. DeMille
*Attorney, Agent, or Firm*—Sughrue, Mion, Zinn, Macpeak & Seas

[57] ABSTRACT

A motorized toy system having current collectors, movable up and down via an elastic member incorporated into a body of the motorized toy. The current collectors protrude on right and left sides of the body and slidably and uniformly contact pole plates disposed on upper end surfaces of side walls formed on both sides of a track. Permanent magnets are disposed at constant intervals on the track so as to alternate their polarities, and the permanent magnets are secured to a first yoke. Electromagnets are mounted in the body, and are secured to a second yoke.

20 Claims, 3 Drawing Sheets

MOTORIZED TOY SYSTEM

BACKGROUND OF THE INVENTION

The present invention relates to a motorized toy system having a toy (i.e.. a vehicle or the like) designed for movement on a designated path. For ease of description, the toy's designated path will be termed herein a track.

One conventional motorized toy system, disclosed in Japanese Patent Laid-Open Publication No. 185283/1989. includes a track, on which a motorized toy travels, the track including permanent magnets continually disposed at constant intervals on a surface of a central portion thereof in its longitudinal direction. The permanent magnets are positioned so that their polarities are alternated. The track on which the toy travels is mounted on a board having printed armatures (pole plates connected to a power supply) which are continually disposed so that the polarities of the armatures also are alternated. The body of the conventional motorized toy is equipped with wheels, each of which is composed of a magnetic material, and three current collectors contiguous to the armatures on the track. The current collectors have rod-like tip parts protruding from the underside of the toy body, and the rod-like tip parts are inserted into central holes of electromagnets loaded thereon.

However, the above-described conventional motorized toy has the following problems:

(1) High voltage must be applied to allow the motorized toy to travel on a vertical or looped portion of the track. This high voltage results in the generation of a large amount of heat, thereby heating the toy body up to an undesirably high temperature. Thus, handling or grasping the conventional toy with an operator's (e.g., a child) unprotected hand is difficult, and moreover is unsafe. While strong magnets for increasing the magnetism thereof may be used to provide better handling characteristics of the toy, this is costly and makes the device larger in size;

(2) The rod-like current collectors, inserted in the central holes of the electromagnets and protruding in a perpendicular direction thereto, are arranged to contact the armatures disposed on the printed circuit board when the current collectors are depressed by a leaf spring. However, this contact is not necessarily continuous nor uniform due to surface variations in the track, and hence the contact between the current collectors and the armatures is likely to be broken while the toy travels on the track. This serves to de-energize the toy. Additionally, the protrusions of the central current collectors become elongated in a looped path, resulting in non-uniform contact between the central current collectors and the armatures. As a result, the current collectors and the armatures easily deteriorate because of this non-uniform contact. Furthermore, adjusting the leaf spring pressures acting on the armatures of the respective current collectors so that they constantly are uniform is difficult: and (3) The armature-printed circuit board disposed above the surface of the central portion of the track is pushed in the longitudinal direction by the rod-like like tip parts of the current collectors. Therefore, the abrasion inherent to a traveling operation is accelerated, and the toy's life-span diminishes.

SUMMARY OF THE INVENTION

In view of the above-described problems of the conventional systems, a primary object of the invention is to provide a motorized toy capable of moving or traveling on a designated path by application of voltages lower than those employed in conventional systems. With lower voltages being applied, the toy can be handled easily since the body of the toy does not become excessively warm. Cost and size increases in the motorized toy to eliminate the effects of the application of higher voltages also can be eliminated.

Another object of the invention is to keep the toy operating uniformly by ensuring that the current collectors uniformly and continuously contact armatures (pole plates) of the track.

A further object of the invention is to lengthen a motorized toy's life-span.

To obviate the above-described problems and achieve the aforementioned objects, according to the invention, there is provided a motorized toy system comprising: a track including permanent magnets, disposed at constant intervals in its longitudinal direction so as to have the polarities of the permanent magnets alternated with respect to each other, and pole plates, connected to a power supply and disposed at constant intervals so that their polarities are alternated with respect to each other; and a body of the toy mounted with current collectors, slidably contacting the pole plates, and electromagnets electrified via the current collectors. The motorized toy system includes side walls formed on lateral sides of the track, and pole plates placed on upper end surfaces of the side walls. A first yoke is attached to each of the permanent magnets. Current collectors, movable upwardly and downwardly via elastic members incorporated into the body of the toy, protrude from both sides of the body of the toy. A second yoke is attached to the electromagnets.

With the arrangement of the invention the motorized toy can move around a track through the application of voltages lower than those used in the conventional systems, thus making the toy easy and safe to handle. Additionally, the toy can be made small as a result of the lower voltages being required to power the toy. Furthermore, by ensuring that the current collectors remain in continuous contact with the pole plates of the track by provision of the elastic members, the toy can be uniformly and continuously powered even when surface variations exist in the track. Since contact between the current collectors and the pole plates is uniformly maintained, abrasion of the pole plates by the current collectors is minimized, and the toy's life-span is increased.

BRIEF DESCRIPTION OF THE DRAWINGS

The above and other objects, features, and advantages of the invention will become more apparent from the following detailed description when taken in conjunction with the accompanying drawings in which.

DETAILED DESCRIPTION OF THE PREFERRED EMBODIMENT

Figure 1:
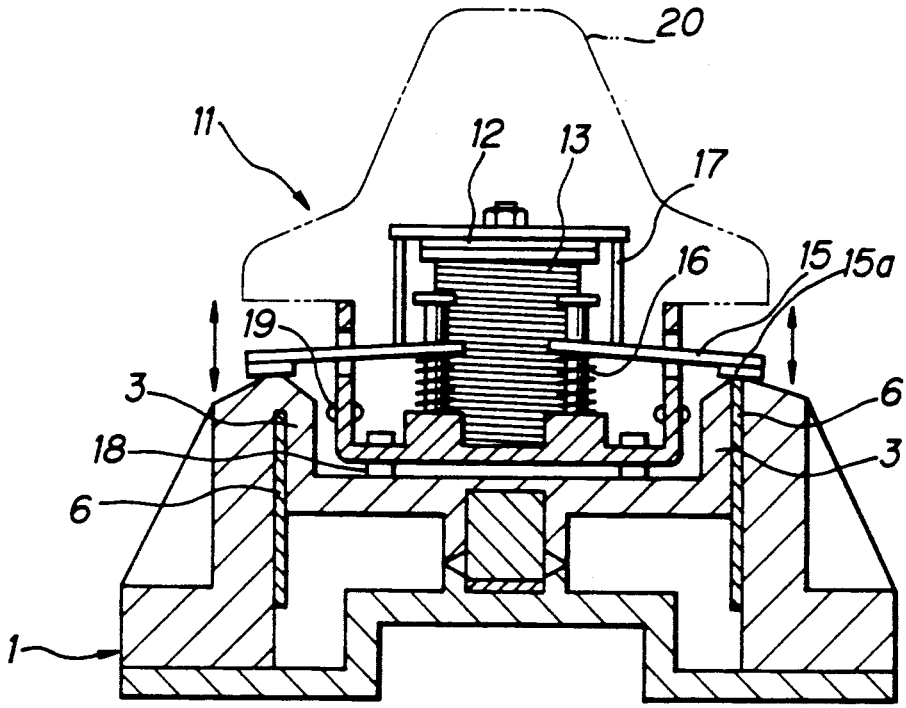
FIG. 1 is a front elevation partly sectional view of a body of the motorized toy placed on a track in accordance with the present invention.
Figure 2:
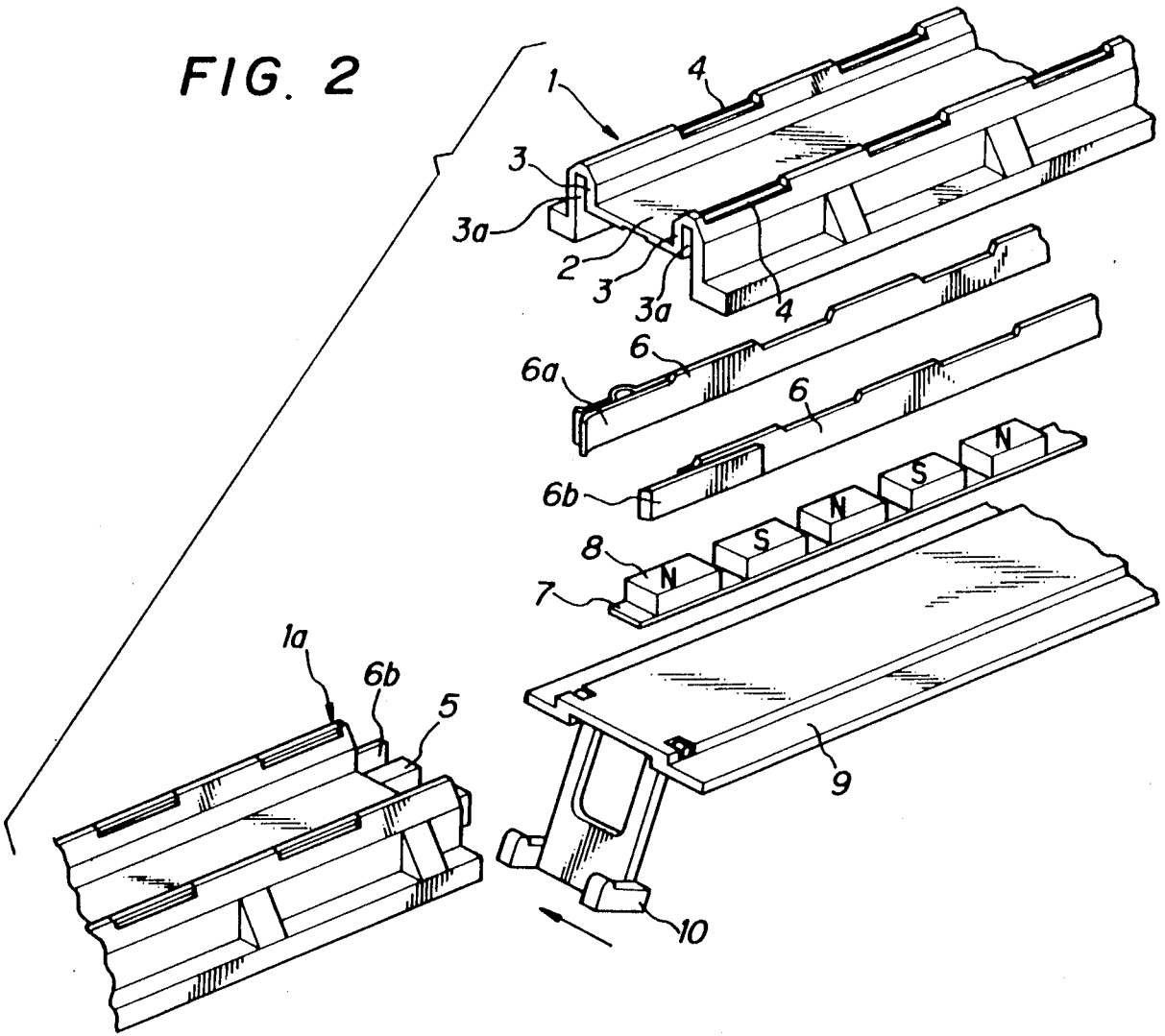
FIG. 2 is an exploded perspective view illustrating a structure of the track.

An embodiment and the operation of the present invention will be described hereinafter with reference to the accompanying drawings. Referring to FIGS. 1 and 2, a track or path 1, composed of a synthetic resin, is formed with side walls 3 in the longitudinal direction thereof on both sides of a surface 2 of the track. Through-holes 4 are bored bilaterally in upper end surfaces of the side walls 3 at constant intervals. Metal pole plates 6 are fitted in grooves 3*a* recessed in the side walls 3, whereby the pole plates 6 are exposed from the upper end surfaces of the side walls 3 at the constant intervals of the through-holes 4. The right and left pole plates 6 are connected, respectively, to positive and negative poles, or negative and positive poles of a power supply (not illustrated). Instead of using the right and left pole plates connected to the poles of the power supply, rod-like members (e.g. copper wire) may be used which are connected to the poles of the power supply. Permanent magnets 8, secured to a yoke 7, are disposed at constant intervals so that their N (north) and S (south) poles are alternated inwardly of the central portion of the track surface 2. Subsequently, the track 1 is fixed to a base board 9, thus constituting a module of the track.

The track modules are connected in the manner described below. Specifically, a protrusion 5 formed at an end of a first track module la is inserted into an interior of a second track module 1. Simultaneously, the pole plates 6 are made conductive by connecting socket members 6*a* and plug members 6*b* provided at the ends of the pole plates 6 to those of the opponent (i.e.. the track module to be connected). The base board 9 of each track module is provided with a movable hook 10 for fixing two track modules (sections) together. Movable hook 10 engages an engagement hole (not illustrated) pierced in the lower surface of the base board of the opposed track module.

The track 1 may assume a variety of configurations such as a rectilinear line, a curve, or a loop.

Figure 3:
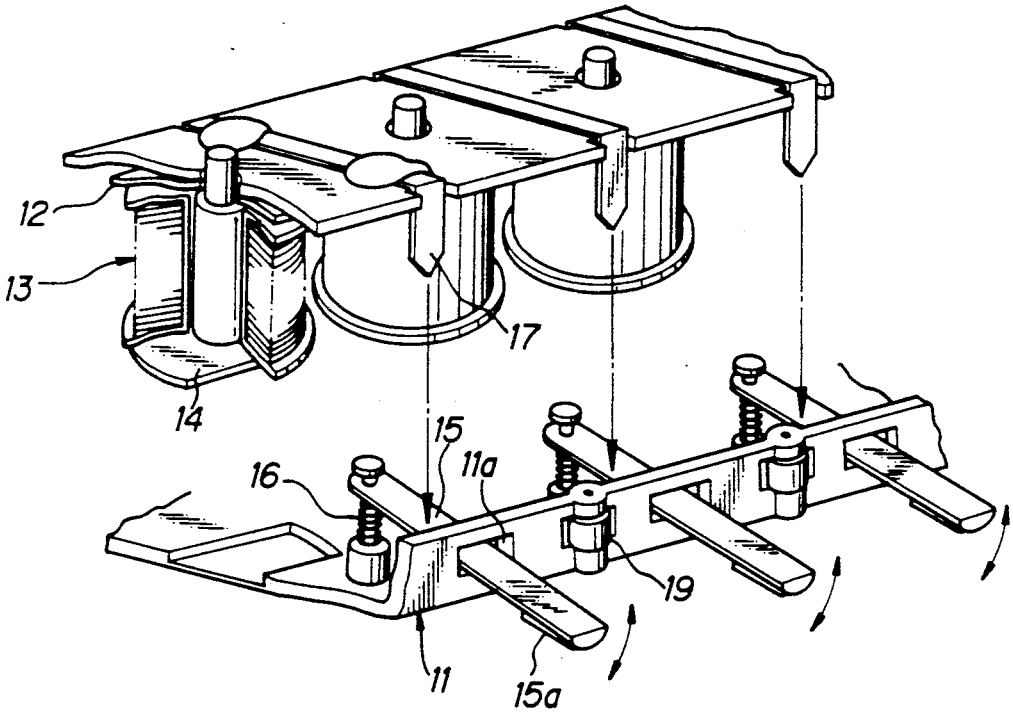
FIG. 3 is an exploded perspective view depicting a principal portion of the body of the motorized toy.

Hereinafter, a body 11 of the motorized toy will be described in detail. Referring to FIGS. 1 and 3, the body 11 is mounted with three electromagnets 13 secured to a yoke 12. Body 11 also is mounted with current collectors 15, disposed in threes and protruding on both sides of the body 11 to supply current to the electromagnets 13. A magnetic core 14, formed of steel, is embedded in each of the electromagnets 13.

As shown in FIG. 3, the current collectors 15 are inserted into small holes 11*a* situated in the side surfaces of the body 11. One end of each of the current collectors 15 is secured to an elastic member or a coil spring 16 to impart an elastic force thereto. The feed armatures 17 (a connection with the electromagnets via a wiring not illustrated), leading to the coil member of the electromagnets, contact the current collectors 15 from above, thus providing contact points. Such a contact state between the armatures and the current collectors is maintained continuously. The current collectors 15 are capable of smoothly and stably oscillating in the directions of the double-headed arrows shown in FIG. 3, i.e., the up-and-down directions, while keeping substantially constant elastic forces.

The body 11 of the motorized toy travels on the track 1 in the manner depicted in FIG. 1. Wheels 18 and 19 are provided on side surfaces of the body 11, as well as at a lower portion thereof, to ensure that contact between the body 11 and the track 1 is uniform and smooth. The body 11 is mounted with a structure 20, which may assume numerous configurations. Tips 15*a* of the current collectors 15, slidably contact the pole plates 6, and may be formed so as to be detachable for easy replacement thereof.

Figure 4:
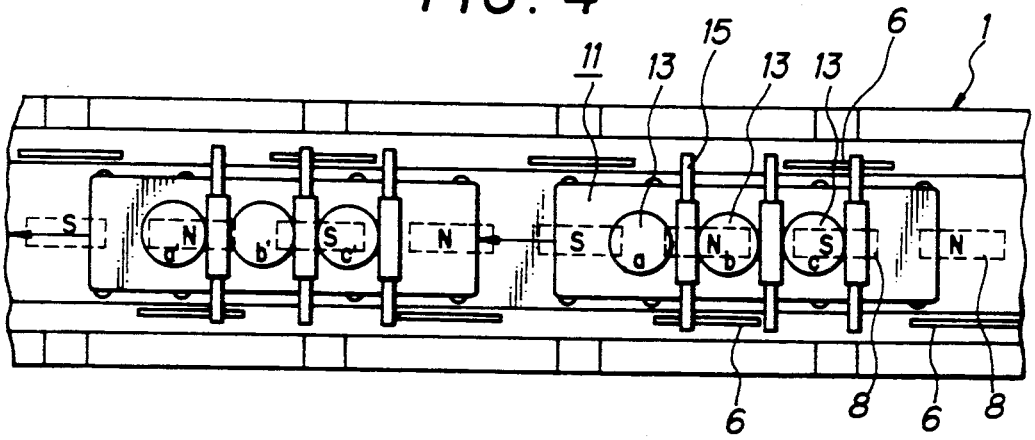
FIG. 4 is a plan view schematically showing a traveling or moving operation by the toy on the track.

A traveling or motorized operation of the body 11 will be explained hereinafter by way of an example. Referring to FIG. 4, in a conductive state (a connecting state not illustrated) as depicted in the right half of the representation of the body 11, a symbol a represents when the electromagnet 13 is magnetized to a north pole located on the side of the track surface, while symbols b and c indicate when the electromagnets 13 are magnetized to a south pole. With this arrangement, the body 11 moves or travels in the direction of the arrows (unreferenced) e.g., in a leftward direction, by the attraction and repulsion forces created with respect to the permanent magnets 8 disposed on the track 1.

In the left half of FIG. 4, symbols a' and c' indicate when the electromagnets 13 are magnetized to the north pole situated on the side of the track surface, while symbol b' represents when the electromagnet 13 is magnetized to the south pole. With this arrangement, the body 11 of the motorized toy continues to travel in the direction of the arrows, i.e., in the leftward direction. The velocity of the body 11 moving on the track 1 can be adjusted by providing a variable resistor. The body 11 can travel in forward and reverse directions by varying the polarity of the power supply.

Additionally, the body 11 may be provided with vehicle linkage members to which other vehicles are linked.

The motorized toy of the present invention is constructed so that the current collectors movable upwardly and downwardly via the elastic member incorporated into the body of the toy, protrude on the right and left sides thereof and slidably and uniformly contact the pole plates disposed on the upper end surfaces of the side walls of the traveling path. As a result of this construction, the current collectors will not be obstructed and damaged by the pole plates unlike those in the conventional systems. Instead, the current collectors uniformly and stably contact the pole plates.

Additionally, the current collectors are able to contact and follow the pole plates continuously and uniformly with a substantially uniform pressing force, even where surface variations occur in the track, to include a looped track, in the up-and-down directions (i.e., in the directions perpendicular to the track surface). Thus, the current collectors and the pole plates continuously and uniformly contact each other.

Furthermore, damage caused by the current collectors abrading the pole plates is avoided, and a longer life-span of the toy is achieved. Since the track is formed with side walls, the vehicle body also is prevented from turning over or running off the track, even when moving or traveling along a curved portion of the traveling path at speeds much higher than those in the conventional systems along a similar track portion.

Still further, attaching the permanent magnets and the electromagnets to the yokes allows high-speed movement of the toy. Movement of the toy around a looped track portion, and rearward movement of the toy is possible, at voltages much smaller than those in the conventional systems, thereby saving electricity and increasing efficiency of the system. Additionally, the temperature of the body of the toy, resulting from heat generated by the applied voltages, can be kept lower than that of the conventional systems, since the voltages used (and thus heat radiated) are lower. Thus, the toy can be easily handled without the danger of an operator being burned. Moreover, the size of the device can be kept small since the voltages applied are smaller, and the attendant safeguards and devices inherent to high voltages are not required. Thus, many features and benefits are achieved by the invention over the conventional systems.

The invention may be embodied in other specific forms without departing from the spirit or essential characteristics thereof. Therefore, the present embodiment is to be considered in all respects as illustrative and not restrictive, with the scope of the invention being represented by the appended claims rather than by the foregoing description. As such, all changes which come within the meaning and range of equivalency of the claims are intended to be embraced therein.

What is claimed is:

1. A motorized toy system comprising:

a track having side walls formed on side edges of said track;

permanent magnets disposed at constant intervals on said track in the longitudinal direction thereof with polarities of said permanent magnets alternated with respect to each other;

a first yoke attached to each of said permanent magnets;

pole plates mounted on said track disposed at constant intervals with polarities of said pole plates alternated with respect to each other, said pole plates contact upper end surfaces of said side walls;

a body;

current collectors mounted on said body slidably contacting said pole plates, said current collectors protrude from first and second sides of said body;

electromagnets mounted on said body receiving current from said current collectors;

a second yoke attached to each of said electromagnets; and elastic members having a first end coupled to said body and a second end coupled to said current collectors so that said current collectors are movable in a direction perpendicular to said track.

2. A motorized toy system as defined by claim 1, wherein said track is formed of synthetic resin.

3. A motorized toy system as defined by claim 1, wherein tips of said current collectors contact said pole plates, said tips being detachable.

4. A motorized toy system as defined by claim 1, wherein said pole plates are fitted in grooves of said side walls.

5. A motorized toy system as defined by claim 1, wherein said current collectors are inserted into small holes situated in said first and second sides of said body.

6. A motorized toy system as defined by claim 1, wherein said current collectors impart a substantially uniform pressing force to said pole plates.

7. A motorized toy system comprising:

a track;

permanent magnets disposed at constant intervals on said track in the longitudinal direction thereof with polarities of said permanent magnets alternated with respect to each other:

pole plates mounted on said track disposed at constant intervals with polarities of said pole plates alternated with respect to each other;

a body;

current collectors mounted on said body slidably contacting said pole plates;

elastic members having a first end coupled to said body, and a second end coupled to said current collectors so that said current collectors are movable in a direction perpendicular to said track; and electromagnets mounted on said body receiving current from said current collectors.

8. A motorized toy system as defined by claim 7, said track comprising side walls formed on side edges of said track.

9. A motorized toy system as defined by claim 8, wherein said pole plates contact upper end surfaces of said side walls.

10. A motorized toy system as defined by claim 7, further comprising a first yoke attached to each of said permanent magnets.

11. A motorized toy system as defined by claim 7, further comprising a second yoke attached to each of said electromagnets.

12. A motorized toy system as defined by claim 7, wherein said current collectors protrude from first and second sides of said body.

13. A motorized toy system as defined by claim 7, wherein said track is formed of synthetic resin.

14. A motorized toy system as defined by claim 7, wherein tips of said current collectors contact said pole plates, said tips being detachable.

15. A motorized toy system as defined by claim 9, wherein said pole plates are fitted in grooves of said side walls.

16. A motorized toy system as defined by claim 12, wherein said current collectors are inserted into small holes situated in said first and second sides of said body.

17. A motorized toy system as defined by claim 7, wherein said current collectors impart a substantially uniform pressing force to said pole plates.

18. A track for use in a motorized toy system, said track comprising:

side wall formed on side edges of said track;

permanent magnets disposed at constant intervals on said track in the longitudinal direction thereof with polarities of said permanent magnets alternated with respect to each other;

a first yoke attached to each of said permanent magnets; and pole plates mounted on said track disposed at constant intervals with polarities of said pole plates alternated with respect to each other, wherein said pole plates are fitted in grooves of said side walls.

19. A track as defined by claim 18, wherein said pole plates contact upper and surfaces of said side walls.

20. A track as defined by claim 18, wherein said track is formed of synthetic resin.

* * * * *